US007775963B2

(12) United States Patent
Samways et al.

(10) Patent No.: US 7,775,963 B2
(45) Date of Patent: Aug. 17, 2010

(54) LIQUID DRIVEN CENTRIFUGAL SEPARATION APPARATUS AND OPEN VESSEL ROTOR WITH IMPROVED EFFICIENCY

(75) Inventors: Andrew Samways, Dorchester (GB); Anthony W. Fell, Yeovil (GB)

(73) Assignee: Mann+Hummel GmbH, Ludwigsburg (DE)

( * ) Notice: Subject to any disclaimer, the term of this patent is extended or adjusted under 35 U.S.C. 154(b) by 1310 days.

(21) Appl. No.: 10/556,489

(22) PCT Filed: May 3, 2004

(86) PCT No.: PCT/EP2004/050677

§ 371 (c)(1),
(2), (4) Date: Nov. 14, 2005

(87) PCT Pub. No.: WO2004/101159

PCT Pub. Date: Nov. 25, 2004

(65) Prior Publication Data

US 2007/0051673 A1 Mar. 8, 2007

(30) Foreign Application Priority Data

May 15, 2003 (GB) ..... 0311173.9

(51) Int. Cl.
*B04B 9/06* (2006.01)

(52) U.S. Cl. ..... 494/49; 494/66

(58) Field of Classification Search ..... 494/24, 494/36, 43, 49, 56, 64–67, 83–84, 901; 210/168, 210/171, 232, 360.1, 380.1, 416.5; 184/6.24
See application file for complete search history.

(56) References Cited

U.S. PATENT DOCUMENTS

| | | | | |
|---|---|---|---|---|
| 1,277,676 | A * | 9/1918 | Wright | 494/43 |
| 2,311,606 | A * | 2/1943 | Bannister | 494/42 |
| 2,668,008 | A * | 2/1954 | Spross | 494/41 |
| 3,231,182 | A * | 1/1966 | Downey | 494/1 |
| 3,235,174 | A * | 2/1966 | Downey | 494/2 |
| 4,356,960 | A | 11/1982 | Carr et al. | |
| 6,013,700 | A | 1/2000 | Asano et al. | |

(Continued)

FOREIGN PATENT DOCUMENTS

DE 32 32 204 A1 3/1984

(Continued)

OTHER PUBLICATIONS

European Search Report dated Jun. 19, 2007 (Three (3) pages).

*Primary Examiner*—Charles E Cooley

(57) ABSTRACT

A centrifugal separation rotor for an apparatus, which removes contaminants from a pumped liquid, such as engine lubricant, by rotating it about axis at high speed includes a separation and containment vessel that permit liquid to leave the vessel as fast as it can enter, so that a zone is defined adjacent a side wall that holds a volume of liquid less than the whole volume encompassed by the vessel walls and filled in conventional high speed separators. A divider wall surface is interrupted by a set of upstanding vanes, which extend along it and around the axle as a helix of such pitch as to form both collector vanes to guide liquid entering between the rotating vanes towards the transfer passage. Motor vanes receive one or more jets of liquid impinging thereon at a glancing angle to drive the rotor before being guided along the inlet zone.

11 Claims, 6 Drawing Sheets

U.S. PATENT DOCUMENTS

| | | | | |
|---|---|---|---|---|
| 6,017,300 | A * | 1/2000 | Herman | 494/49 |
| 6,019,717 | A * | 2/2000 | Herman | 494/49 |
| 6,533,713 | B1 * | 3/2003 | Borgstrom et al. | 494/66 |
| 6,984,200 | B2 * | 1/2006 | Samways | 494/49 |
| 7,297,098 | B2 * | 11/2007 | Fell | 494/49 |
| 2004/0152578 | A1 * | 8/2004 | Samways | 494/49 |
| 2006/0063658 | A1 * | 3/2006 | Fell | 494/49 |

FOREIGN PATENT DOCUMENTS

| | | | |
|---|---|---|---|
| GB | 2401564 | A * | 11/2004 |
| WO | WO 02/055207 | A1 | 7/2002 |

* cited by examiner

LIQUID DRIVEN CENTRIFUGAL SEPARATION APPARATUS AND OPEN VESSEL ROTOR WITH IMPROVED EFFICIENCY

FIELD OF THE INVENTION

This invention relates to centrifugal separation apparatus for separating particulate contaminants from liquids, such as circulating lubricating oil of internal combustion engines, passed through the apparatus to effect cleaning, and in particular relates to rotor means used within such apparatus to perform the actual separation and containment of such contaminants. The invention is more particularly concerned with fluid driven separation apparatus and a rotor therefor wherein the rotor includes a container vessel that is rotated at high speed by a limited motive force derived from a fluid such as the liquid itself and even more particularly concerned with such separation apparatus having a rotor of the so-called open-vessel type discussed in more detail hereinafter.

BACKGROUND OF THE INVENTION

The advantages of centrifugal separation in internal combustion engine oil filtration is well documented in the art, although requirements for modern engines to cater for longer service intervals by ensuring efficient removal of small particles produced throughout the interval by combustion products (sometimes referred to as soot) place conflicting constraints upon such separation apparatus, particularly in respect of requiring very high speeds from a limited source of rotor motive power is, such as the liquid being cleaned.

The difficulties and conflicting requirements for removing such small particulates centrifugally within apparatus economically, physically and functionally suited for a vehicle are set out in U.S. Pat. No. 6,013,700 and in WO-A-02/055207, the latter of which proposes a number of embodiments for a so-called open vessel centrifugal separator rotor that permits not only a long dwell time for oil in the rotor but also operates with a low oil mass in the rotor that permits the separation interface to be further spaced form the rotation axis than previously and faster rotation speed to be achieved with fluid pressure as the motive force. Most significantly, it is capable of being driven at the necessary speed by the oil to be cleaned, as well as, or instead, by liquid or other fluid from that or a separate source. Unlike the more traditional type of centrifugal separator, wherein a rotor comprises a generally cylindrical vessel which is filled with the liquid at elevated pressure by restricting the rate at which the liquid can escape, that is exemplified by the U.S. Pat. No. 6,013,700, the open vessel centrifuge has a liquid-filled separation and containment zone defined adjacent a circumferentially outer wall and extending radially inwardly therefrom only as far as outlet passage means at which liquid can escape at a rate in excess of supply, thereby creating a "shell" of liquid, instead of a container full, that permits faster, less power consuming rotation In one particular embodiment shown in WO 02/055207 that represents an arrangement suitable for use with an automobile engine, the separation apparatus is mounted to provide a substantially vertical rotation axis for the rotor having such open vessel construction and the liquid to be cleaned is sprayed as a free jet towards inlet means, comprising an annular inlet region extending along and around the rotation axis, separated from the vessel separation zone by a dividing wall having an upwardly divergent collection surface rotating with the vessel, whereby the liquid impinging on the surface is caused by what is conventionally called centrifugal action to collect and spread as a film and migrate longitudinally upwardly and radially outwardly, acquiring by frictional drag a rotational velocity close to, but less than, that of the vessel outer peripheral wall before being freed to transfer from the inlet region to the separation and containment zone. Rotational energy for the whole rotor is derived by causing a jet of liquid or other fluid to impinge on reaction turbine vanes, buckets or like surfaces which react to liquid impingement to drive the rotor, preferably using the liquid to be cleaned and directing the spent liquid onto the inlet means collection surface for conveying to the annular contaminant separation and containment zone defined by the outer peripheral wall of the container vessel as described above.

Although open vessel centrifugal separation apparatus has a more general applicability than in relation to internal combustion engines of vehicles, design of a simple open vessel centrifuge for use with internal combustion engines for automobiles, trucks and like mass produced transport vehicles is constrained by a variety of factors, in particular the cost of manufacture, complexity, size and the like, which effectively limit the source of power and place practical limitations on achieving the high rotational speeds required, such that it is important to ensure that motive power and energy put into rotating the rotor is used most efficiently and not wasted.

It is an object of the present invention to provide liquid driven centrifugal separation apparatus, and open vessel rotor therefor, of greater efficiency than hitherto.

According to a first aspect of the present invention a rotor for centrifugal separation apparatus for separating solid contaminants from a liquid comprises a walled contaminant separation and containment vessel having a longitudinally extending rotation axis, an impervious outer side wall extending about and along the rotation axis spaced radially therefrom and at least one end wall extending from the side wall towards the rotation axis, outlet passage means, leading externally of the vessel disposed radially inwardly with respect to the outer side wall, said walls defining radially inwardly from the outer side wall an annular contaminant separation and containment zone and the outlet passage means defining the radial boundary of the zone, inlet means, arranged to receive liquid to be cleaned and convey it to the contaminant separation and containment zone at a rate less than liquid can be passed by the outlet passage means, mounting means for mounting the rotor for rotation of the vessel about the longitudinal rotation axis, and fluid motor impeller means disposed to receive a jet of drive fluid thereagainst and responsive to drive fluid impingement to rotate the rotor about said longitudinal rotation axis, said inlet means further comprising a liquid inlet region, defined about and along the rotation axis by a divider wall disposed radially between the outlet passage means and the rotation axis, having a liquid inlet end, transfer passage means, spaced from the inlet end, permitting liquid flow between the inlet region and contaminant separation and containment zone, and a collection face of said divider wall facing inwardly towards the rotation axis, characterised in that the inlet means includes collection impeller means comprising at least one collection impeller vane upstanding with respect to the divider wall collection face into the inlet region and extending about the rotation axis and along the divider wall from said inlet end towards said transfer passage means along a helical path, to constrain the liquid to be cleaned injected into the inlet region to follow a helical path in the direction of rotation of the rotor inlet means towards the transfer passage means.

Most conveniently there are a plurality of collection impeller vanes constraining liquid to travel between them.

The motor impeller means may comprises a plurality of helical motor impeller vanes each having surfaces disposed at or adjacent the inlet end of the inlet means, each upstanding with respect to said dividing wall collection face. At least some of the motor impeller vanes may be arranged such that spent drive fluid deflected thereby is directed along the inlet region. Such motor impeller vanes may be axially disposed with respect to the collector impeller vanes such that their function are separated axially or they may overlap axially.

In a preferred form the collection impeller vanes comprises the fluid motor impeller vanes, so that the drive fluid, which may be the contaminated liquid for cleaning, is caused to impinge upon the impeller vanes spread along the inlet region such that energy for rotation is transferred to the rotor through a large part of its travels along the region, not just as a result of impact with a small area of vane near the inlet end.

According to a second aspect of the present invention a centrifugal separation rotor comprising a walled contaminant separation and containment vessel having a longitudinally extending rotation axis, an impervious outer side wall extending about and along the rotation axis spaced radially therefrom and at least one end wall extending from the side wall towards the rotation axis, including outlet passage means, leading externally of the vessel, disposed radially inwardly with respect to the outer side wall, said walls defining radially inwardly from the outer side wall an annular contaminant separation and containment zone and the outlet passage means defining the radial boundary of the zone, inlet means, arranged to receive liquid to be cleaned and convey it to the contaminant separation and containment zone, and fluid motor impeller means to rotate the rotor about said longitudinal rotation axis, also has, between the outer peripheral wall and the outlet passage means of at least one end wall, a discharged liquid guide extending longitudinally with respect to a said end wall operable to inhibit contact between liquid discharged from the rotor vessel by way of the outlet passage means and the external surface of the rotor vessel radially outwardly of the discharged liquid guide.

The rotor may be like that of the preceding two paragraphs insofar as the inlet means further comprises a liquid inlet region, defined about and along the rotation axis by a divider wall disposed radially between the outlet passage means and the rotation axis, and collection impeller means. The discharged liquid guide may comprise a tubular skirt or equivalent surrounding the rotation axis and an annular form of passageway formed by one or more apertures through the end wall, or may comprise one or more tubular ducts each associated with an end wall aperture and extending away from the wall parallel to and or inclined with respect to the rotation axis.

In accordance with a third aspect of the present invention centrifugal separation apparatus comprises a rotor having a liquid separation and containment vessel, a housing including mounting means to support said rotor for rotation about a rotation axis, drainage means to direct liquid exiting the vessel away from the rotor, fluid motor turbine means including drive fluid nozzle means operable to direct a stream of drive fluid to motor impeller vanes of the rotor, and vessel supply means operable to direct liquid to be cleaned to the rotor vessel, and is characterised by the rotor comprising a rotor as defined by any one of the preceding six paragraphs and the rotor vessel supply means comprising liquid nozzle means operable to direct a jet of said liquid to the inlet end of the rotor inlet means.

Preferably the apparatus is arrange to operate with the rotation axis substantially vertical such that the liquid is arrange to move through he inlet region subjected uniformly at all positions about the rotation axis to a relatively strong centrifugal force towards the wall surface a relatively weak gravitational force. Because the gravitational force is so weak in relation to the centrifugal force, to orientation of the inlet and transfer passage ends of the inlet means may be inverted.

BRIEF DESCRIPTION OF THE DRAWINGS

Embodiments of the invention will now be described by way of example with reference to the accompanying drawings, in which.

DETAILED DESCRIPTION OF THE PREFERRED EMBODIMENTS

Figure 1:
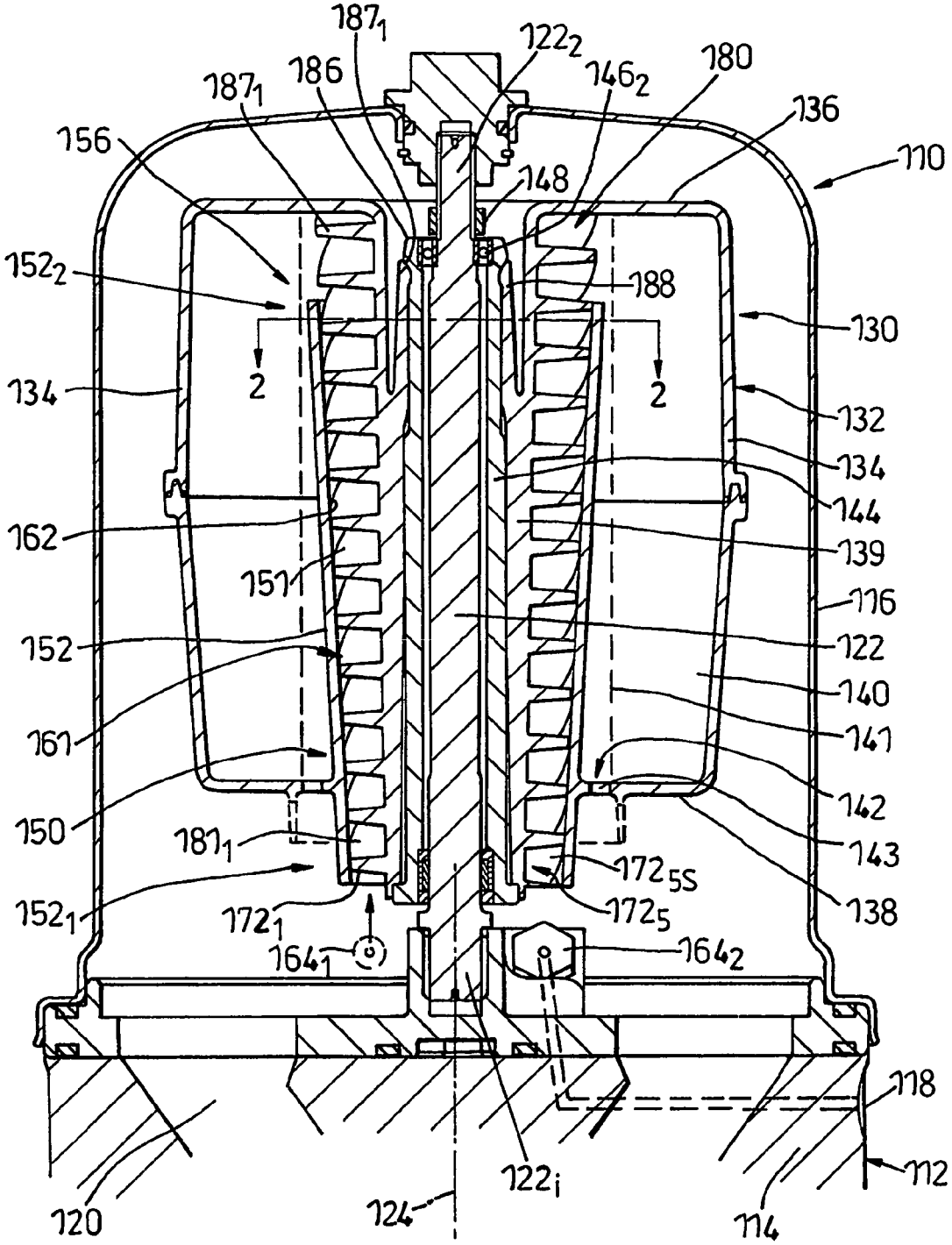
FIG. 1 is a sectional elevation through a first embodiment of centrifugal separation apparatus in accordance with the invention, including a rotor for receiving contaminated liquid to be cleaned and providing for separation and containment of contaminants, fluid motor drive means for the rotor provided by the source of the contaminated liquid, rotor liquid inlet means in the form of an annular inlet region provided by a surrounding annular divider wall and collection impeller vanes, the collection impeller vanes also providing fluid motor impeller vanes for rotation.
Figure 2:
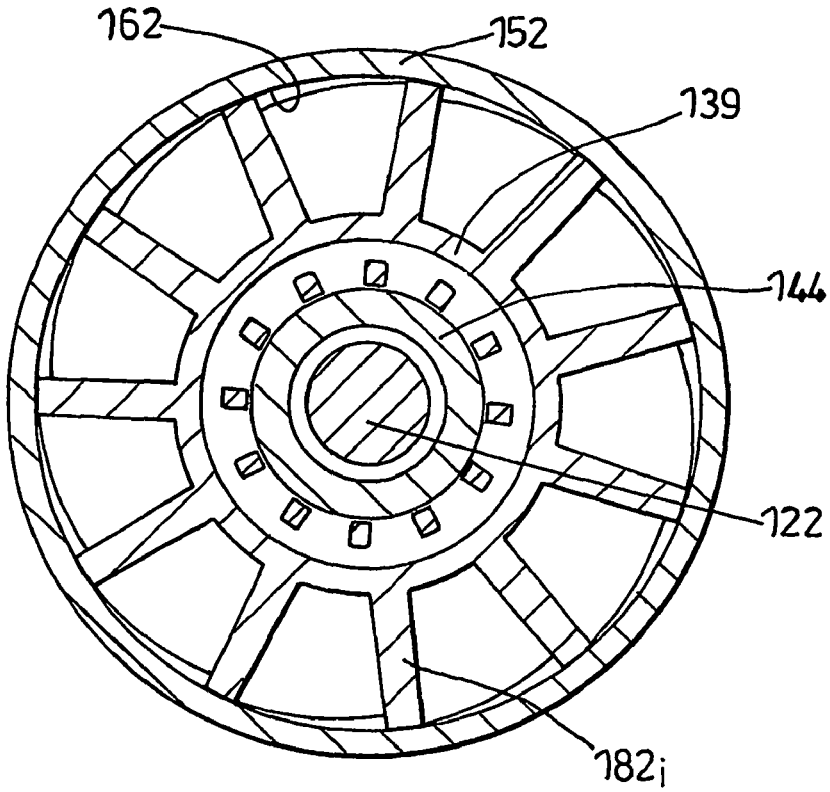
FIG. 2 is a cross-section through the inlet means of FIG. 1 in the direction 2-2, illustrating the collection impeller vanes arrayed around the rotation axis.
Figure 3:
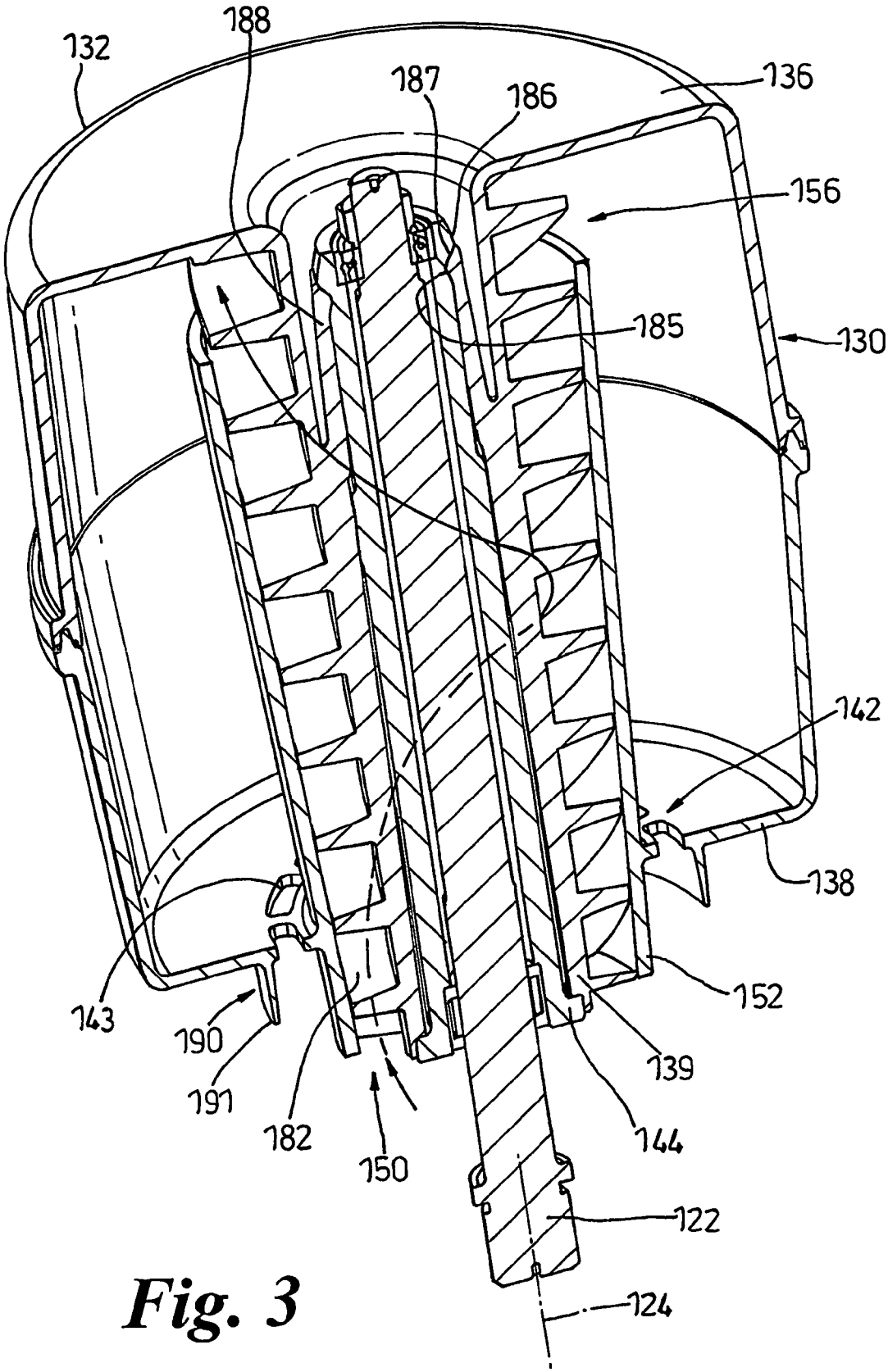
FIG. 3 is an alternative cut-away perspective view of the separation apparatus rotor mounted and upstanding spindle of FIG. 1, showing the path taken by contaminated liquid through the rotor and, in the end wall forming its base different forms of optional discharged liquid guide, FIGS. 4(*a*) to 4(*c*) are schematic section elevations through component parts of the rotor of FIG. 1 in exploded, pre-assembled relationship illustrating its construction.

Referring to FIGS. 1 to 3, a first embodiment of centrifugal separator 110 comprises a housing 112 defined by a base 114, adapted to be affixed to the engine block of an internal combustion engine (not shown), and a removable cover 116. The base includes inlet duct means 118, by which contaminated lubricating oil is supplied at elevated pressure and comprises a liquid to be cleaned, and outlet duct means 120 for drainage of liquid from the housing to the engine sump.

A spindle or axle 122, having longitudinal axis 124, is supported at one end thereof $\mathbf{122}_1$, by the base and extends through the housing and engages at its other end $\mathbf{122}_2$ with the cover 116. The separator is designed to be mounted with the axis 124 substantially vertical. Although this is not essential for the purposes of operation, it is preferred in practice.

Mounted on the spindle for rotation about the axis 124 within the housing is a rotor 130, comprising a walled contaminant separation and containment vessel 132 (hereafter referred as "the vessel") which has an impervious, radially outer side wall 134, extending about, and lengthways of, rotation axis 124 between end walls 136 and 138, and a radially inner side wall defined by a tubular sleeve 139. Radially inwardly from the side wall 134 is an annular contaminant separation and containment zone 140 (hereafter referred to as "the zone"), the radially inner boundary of the zone, as denoted by the broken line 141, being defined by the position of outlet passage means 142 in the end wall 138 which leads externally of the vessel within the housing. The outlet passage means 142 comprises one or more apertures 143 in the end wall 138, shown in the form of circumferentially extending slots, and the end wall 138 is connected to inlet means, indicated generally at 150 and described hereinafter, which is arranged to convey contaminated liquid from radially inwardly thereof to the zone 140. The outlet passage means 142 is preferably formed, as shown, in the end wall that forms the base of the vessel, but need not be. Furthermore, the outlet passage means may alternatively be defined by an annular gap representing a radial space between the end wall and the inlet means.

The rotor 130 also comprises a hub 144 by which it is mounted with respect to the spindle 122. The hub 144 surrounds the spindle and is mounted by axially spaced needle roller bearings $\mathbf{146}_1$, $\mathbf{146}_2$, or equivalent low friction bearings, and held captive by a nut 148 or analogous retaining clip or device. The inner wall sleeve 139 of the vessel surrounds the hub to effect mounting of the vessel for rotation with the hub.

The inlet means 150 comprises a liquid inlet region 151 defined about and along the rotation axis by a divider wall 152, also extending around and lengthways of the rotation axis 124, disposed radially between the coaxial sleeve and hub combination and the zone 140. The divider wall 152 is thus mounted in fixed relationship to the hub and the vessel walls for rotation therewith. The liquid inlet region has a liquid inlet end, indicated generally at 154, separated axially from transfer passage means, indicated generally at 156, that permits liquid flow between the inlet region and the zone 140.

The divider wall 152 is tapered, increasing in radius as a function of distance from its lower end $\mathbf{152}_1$, at the liquid inlet end 154 to its upper end $\mathbf{152}_2$, which is spaced axially from the vessel end wall 136 so as to provide the transfer passage means of substantially unobstructed annular form. Thus, the divider wall at the transfer passage end has a greater radius, and is closer to the vessel side wall 134, than at the inlet end.

The inlet means 150 further comprises collection means, indicated generally at 161, defined in part by a collection face 162 of the divider wall facing inwardly towards the rotation axis. The collection means functions to contain liquid injected into the liquid entry end of region 151 and convey it towards the transfer passage means, using any momentum of the injected liquid and rotation of the collection face.

The contaminated liquid to be cleaned is in principle injected into the inlet end of the inlet means as a free jet from nozzles $\mathbf{164}_1$ $\mathbf{164}_2$ etc to make contact with, and be contained by the rotating collection face of the divider wall until conveyed to the transfer passage means.

To effect such rotation, the separation apparatus 110 includes fluid motor means, shown generally in FIG. 1. The rotor comprises a plurality of motor impeller vanes $\mathbf{172}_1$, $\mathbf{172}_2$, . . . $\mathbf{172}_i$, where i=11 in this example, arrayed about the rotation axis, each vane extending from at least one of the divider wall and sleeve towards the other across the mouth of the inlet region and for at least a short distance in the direction of the rotation axis, in order to receive a free jet of drive fluid thereagainst from one or more complementary nozzles carried by the base, whereby the vanes, in reaction to drive fluid impingement, impart rotation of the rotor as the fluid is deflected thereby, spent of some of its energy.

For convenience rather than necessity, in this embodiment the drive fluid is the contaminated liquid (oil) to be cleaned and the nozzles $\mathbf{164}_1$, $\mathbf{164}_2$ direct the pressurised contaminated liquid onto the impeller vanes $\mathbf{172}_1$ etc. which are dimensioned and shaped to deflect the liquid, retaining some of its energy and momentum from the free jet into the inlet region, so that it is able to make contact with the collection face of the divider wall.

Insofar as the motor impeller vanes are disposed at or adjacent the inlet end 152 of the inlet region dimensioned and shaped to deflect the liquid from the free jet, along the inlet region so that it is able to make contact with the collection face of the divider wall, the above described component parts of the separation apparatus and rotor conform to the disclosure of the above mentioned WO 02/055207.

However, whereas in that arrangement each liquid jet was concentrated to impinge upon a relatively small area of impeller vane at the inlet end of the inlet region and splash or deflect liquid considered spent of useful energy onto the collection ace 152 alone, in accordance with the present invention the inlet means 150 includes collection impeller means, indicated generally at 180.

As seen more clearly in FIGS. 2 and 3, the collection impeller means comprises a plurality of collection impeller vanes $\mathbf{182}_1$ to $\mathbf{182}_i$ (where i=11) each upstanding with respect to the divider wall collection face 162 into the inlet region 151 and extending around the rotation axis and along the divider wall from the inlet end towards the transfer passage means along a helical or screw path.

In this embodiment each of the eight collection impeller vanes conveniently, but not necessarily, extends beyond the end $\mathbf{152}_2$ of the divider wall and follows a helical path that has a pitch angle with respect to the rotation axis of less than about 60° and for reasons which will become clear a pitch angle of 45°±10° is preferred. The number of complete turns made by each of the vanes about the longitudinal (rotation) axis is dependant of course on the length of the vessel but typically is less than two turns. Each collection impeller vane, such as say $\mathbf{182}_i$, also has a primary face $\mathbf{182}_{iP}$ facing (albeit obliquely) in a direction towards the transfer passage means and a secondary face $\mathbf{182}_{iS}$ facing generally away from the transfer passage means in the direction of the inlet end. The vanes each extend substantially perpendicularly with respect to the collection face, that is, radially, and are substantially equally spaced.

The collection impeller means 180 may be structurally separate from the motor impeller means but in this embodiment, is integrated with, and considered in part to function as, a distributed motor impeller means. For this reason it is appropriate to refer to the dual function impeller vanes simply as "impeller vanes".

Thus, in this embodiment, although others will be described hereinafter, such integration of impeller vanes means that not only are there the same number of collection impeller vanes as rotor impeller vanes and these are functionally aligned, but the motor impeller vanes are inherently upstanding with respect to the divider wall collection face 162 and have, for their functional length, the same helical pitch and the same primary and secondary faces as the collection impeller vanes.

Nozzle $\mathbf{164}_1$ and any others are arranged to direct the free jets of contaminated liquid at a position periodically occupied by the primary ace of each impeller vane and cause the jet of liquid to impinge on the vane at a shallow or glancing angle such that impingement, which exerts a motive force on the vane, is distributed not only spatially along the vane but also temporally as the vane rotates, the liquid being contained in the inlet region by the collection face and vanes and thereby constrained to follow a helical path in the direction of rotation of the rotor, gradually exchanging the energy brought with it and retained thereby after movement out of the path of the nozzle jet by, imparting a rotation force by way of the primary face of the impeller vanes. Such continual exchange of energy enables more to be extracted from the liquid and a greater rotation speed to be achieved without compromising on the injection of contaminated liquid into the inlet region (as compared with a limited exchange possible and wastage from a simple impulse turbine and limited liquid injection from one as efficient as a Pelton wheel bucket arrangement). However, it is not only the rotation speed of the rotor per se which is of importance; the liquid conveyed along the inlet region, whilst losing its "brought" energy to the impeller vanes in their motor function, also acquires rotational energy from being forced against the collection face 162 of increasing radius and prevented from slippage relative thereto by the arrayed upstanding impeller vanes in their collection. The instantaneous linear speed of the liquid, tangentially to the rotation direction, as the liquid moves towards the transfer passage means increases such that when it leaves the inlet means and is flung to the side wall 134 of the separation and containment zone, there is less speed differential than might otherwise be the case, ensuring that the liquid minimises disturbance of conditions in the zone 140 and contaminant separation conditions are achieved for that liquid more quickly.

Although functional interaction between liquid within the inlet region and the impeller vane occurs principally in the vicinity of the collection face of the divider wall rather than the tubular sleeve 139 at the hub, it is convenient to define substantially closed collection ducts circumferentially between adjacent vanes, subject to the constraints of economic manufacture.

Figures 4A, 4B, 4C:
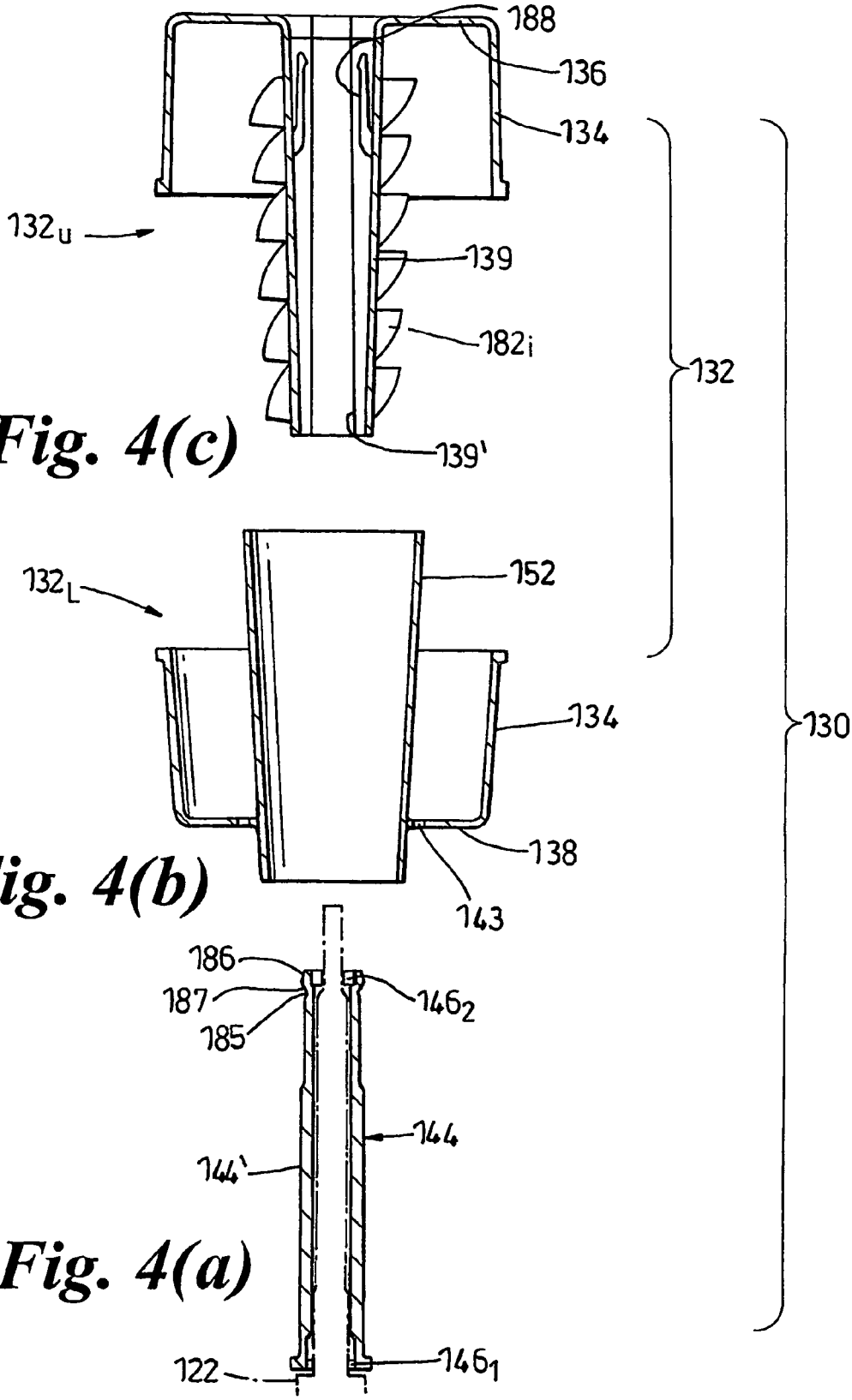

Referring to FIG. 4, this shows a more schematic sectional elevation the rotor vessel hub and spindle arrangement of FIG. 1 prior to assembly to illustrate a preferred manufacture. The rotor 130 comprises three components which are principally unitary mouldings of plastics material or materials. For the purpose of cleaning an internal combustion engine lubricant at the working temperature typical thereof and providing a suitable combination of strength and lightness, a glass loaded nylon material may be employed FIG. 4(*a*) shows a tubular hub moulding 144 with mounting bearings $\mathbf{146}_1$ and $\mathbf{146}_2$ and arranged to be secured with respect to solid axle 122 (shown ghosted) extending upwardly from the base of the separation apparatus housing. The hub is intended to remain in place on the axle once fitted and the outer surface 144' of the hub is ribbed or splined along at least part of its length.

Figure 5:
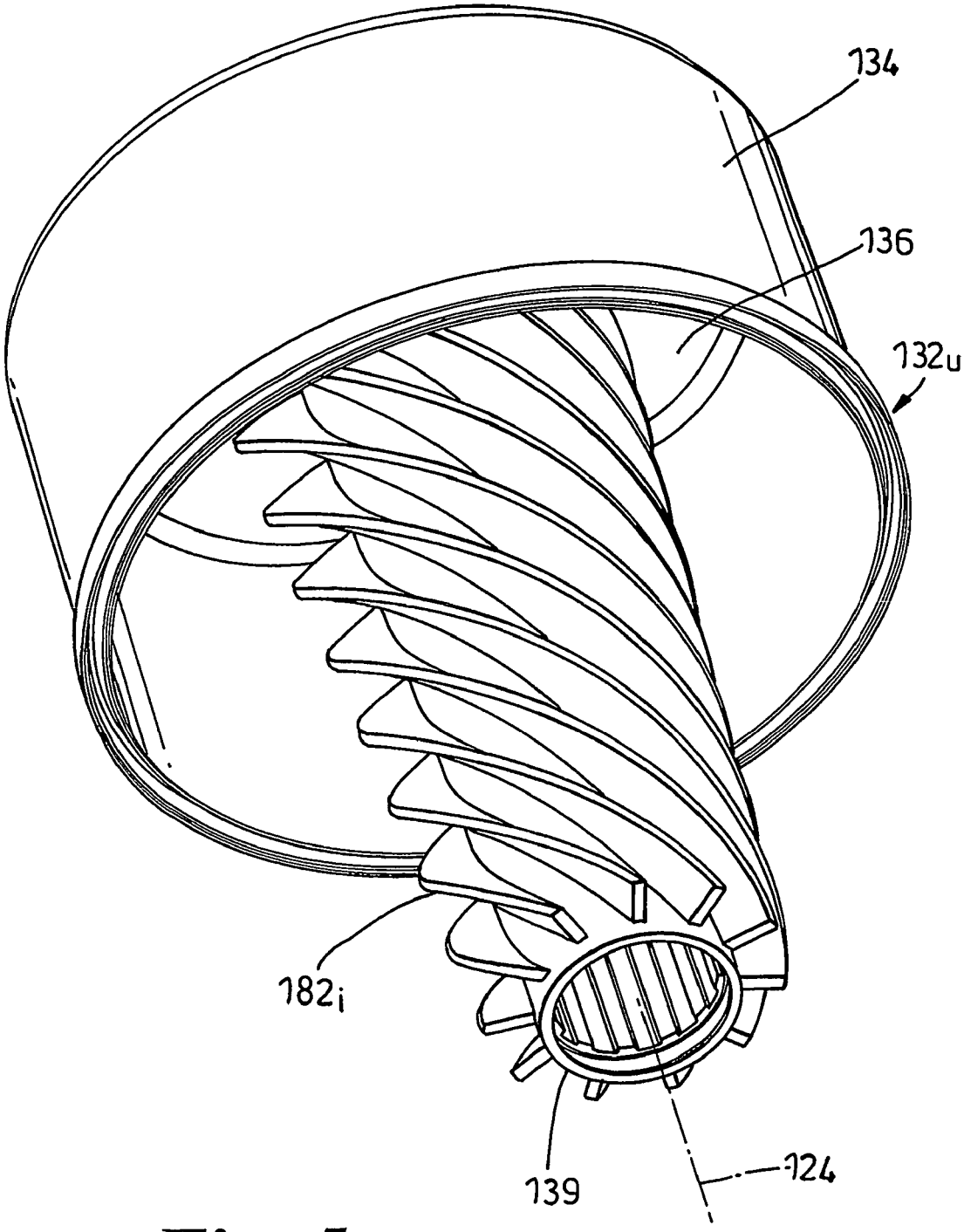
FIG. 5 is a partly cut-away perspective view of the rotor upper part of FIG. 4(*c*), showing details of the collection impeller vanes thereof moulded integrally with a sleeve forming the inner wall of the inlet region.

The rotor vessel 132 is formed in two parts as shown in FIGS. 4(*b*) and 4(*c*), a lower part $\mathbf{132}_L$ in FIG. 4(*b*) and upper part $\mathbf{132}_U$ in FIG. 4(*c*). The upper part is a unitary moulding of plastics material, comprising part of outer side wall 134, the upper end wall 136, the inner side wall/tubular sleeve 139 and, extending outwardly from the sleeve, the impeller vanes $\mathbf{182}_1$ to $\mathbf{182}_{11}$. The inner surface 139' of the tubular sleeve 139 is dimensioned and recessed or splined in a manner to cooperate with the external surface 144' of the hub, facilitating relative displacement longitudinally for assembly or disassembly but not rotationally. It will be seen that in addition to the impeller vanes tapering to decreased width and distance from the tubular sleeve as a function of distance from the end wall 136, the side wall 134 also displays a slight taper, facilitating moulding. FIG. 5 provides a perspective view of this upper part, more clearly showing the shape and disposition of the impeller vanes.

FIG. 4(*b*) shows as a corresponding unitary moulding the lower part of the vessel $\mathbf{132}_L$ comprising the remainder of outer side wall 134, lower end wall 138 with outlet passage slots 143, and divider wall 152. Both the divider wall and side wall taper to increasing radius as a function of distance from the end wall.

It will be seen that the vessel is readily formed by assembling the upper and lower parts together and joining the outer walls. Such assembly includes locating the inner wall/sleeve 139 and impeller vanes within the divider wall 152, thereby defining the inlet means 150 and the separation and containment zone 140. The parts may be joined permanently, defining a sealed vessel which is discarded and replaced when the separation and containment zone becomes full contaminants, or may be separable to permit cleaning and reuse. In either case, the intact vessel is releasably mounted on the hub. It is particularly advantageous that the vessel mounting bearings are carried by, and remain in, the hub, making the vessel itself more readily discardable insofar as, subject to contaminants removal, the vessel comprises only recyclable plastics (and possibly inert filler) material.

Notwithstanding that the divider wall and impeller vanes are formed in different parts prior to assembly, these parts may be moulded with sufficient precision by conventional moulding techniques that the vanes abut the collection face of the wall and effect a close, upstanding relationship therewith.

It will be appreciated that other constructions may be made as desired. For example, the outer wall 134 may be formed on the upper or lower part only and joined with the end wall of the other part to define the vessel. The impeller vanes may be moulded integrally with the divider wall of the lower moulding of FIG. 4(*b*) leaving a tubular space for receiving the tubular sleeve 139 of the upper part during assembly. Such space may be made to have uniform diameter by increasing the vane width towards the upper end, that is, correspond to FIG. 1, or the vanes may be of uniform width so as to have edges which lie parallel to the divider wall spaced from the sleeve 139 towards the transfer passage end whereby a region surrounding the inner wall 139 is open circumferentially. Alternatively, the tubular body, divider wall and impeller vanes may be made as a unitary moulding and the upper and lower vessel wall parts assembled around it. Notwithstanding the width of each vane and its relationship with the divider wall surface 162 and inner wall 139, and its pitch angle longitudinally, it may extend with respect to the walls other than perpendicularly, that is radially, being inclined to the radial direction.

To provide for ready location of the vessel on the hub 144 and compatible with the moulded parts construction the end of the hub is provided with a detent groove 185 and chamfered surfaces in the groove and to one side of the groove at 186 and 187 respectively. The inner tubular wall 139 of the vessel has towards its upper end a plurality of resilient fingers 188 around the longitudinal axis and biased towards it such that in locating the tubular wall on the hub the finger tips are forced apart by the hub surfaces 186 and 187 and locate in the detent groove to secure the vessel with respect to the hub. Removal of the vessel from the hub requires only that the fingers be displaced and/or longitudinal force be applied to cause the detent groove surface 187 to act as a cam and effect the separation that permits removal. If desired, inadvertent removal could be prevented by surrounding the arranged fingers with a ring, possibly carried by the housing cover 116.

Whilst there are manufacturing conveniences and preferences for forming the rotor, and particularly the vessel, parts from plastics materials, it will be appreciated that some or all of the parts may be formed of other materials, particularly sheet metal.

Although the invention has been described by way of an embodiment in which the inlet means has a divider wall collection face tapering linearly with increasing radius towards the transfer passage means in order to maximise the linear speed of the liquid before transfer, it will be appreciated that the divider wall collection face taper may be other than linear along the inlet region and that advantages due to the extensive helical impeller vanes may be obtained having a divider wall that does not diverge at all, the inlet region maintaining substantially uniform diameter between inlet end and transfer passage means.

It will also be understood that the transfer passage means may comprise other than the upper edge or rim of the divider wall. Although providing for maximum circumferential transfer, the passage means may alternatively comprise discrete apertures through the divider wall at locations along the length of the inlet region as described in the aforementioned WO 02/055702.

It will be appreciated that insofar as the impeller vanes serve to extract energy from the incoming liquid to benefit rotation and to impart to the liquid at the collection face an increased linear speed as it approaches the transfer passage means, the vane configurations may vary along the length of the inlet region to optimise each function.

The pitch angle of each vane may vary along the length of the inlet means, for example reducing as a function of distance from the inlet and, possibly continuously or in steps in different longitudinal regions.

In this context the number of vanes associated with the dual function or individual functions may vary from the exemplary eight shown.

Although it is convenient for the impeller vanes to extend for at least the full length of the inlet region, it will be appreciated that the vanes may stop short of the transfer passage means and/or different sets of impeller vanes extend along different parts of the inlet passage; within the context of the vanes having a dual role it will be appreciated that the contribution of each vane to that role varies as a function of distance along the inlet region. Therefore if the ostensibly dual role impeller vanes are provided by different sets axially such sets may also be offset circumferentially, have different numbers of vanes and pitch angles in terms of inclination with respect to the rotation axis and may each be adapted to performing one of the motor and collection functions in preference to the other. For example, towards the transfer passage means where vane function is principally aimed at encouraging rotation of the liquid at the collection face, and extraction of motive force from the liquid is small, the impeller vanes may be inclined differently from to those nearer the inlet end so as to more positively pump the liquid towards the passage means, in effect comprise dedicated collection impeller vanes.

Whereas the invention has thus far been described having impeller vanes performing dual roles of providing rotation force from the injected contaminated liquid and collecting and impelling the injected liquid towards the transfer passage means, such functions may be separated or one of them provided additionally by specifically configured impeller vanes or their equivalent. This is particularly true in respect of providing separate or additional rotor impeller vanes.

Figure 6:
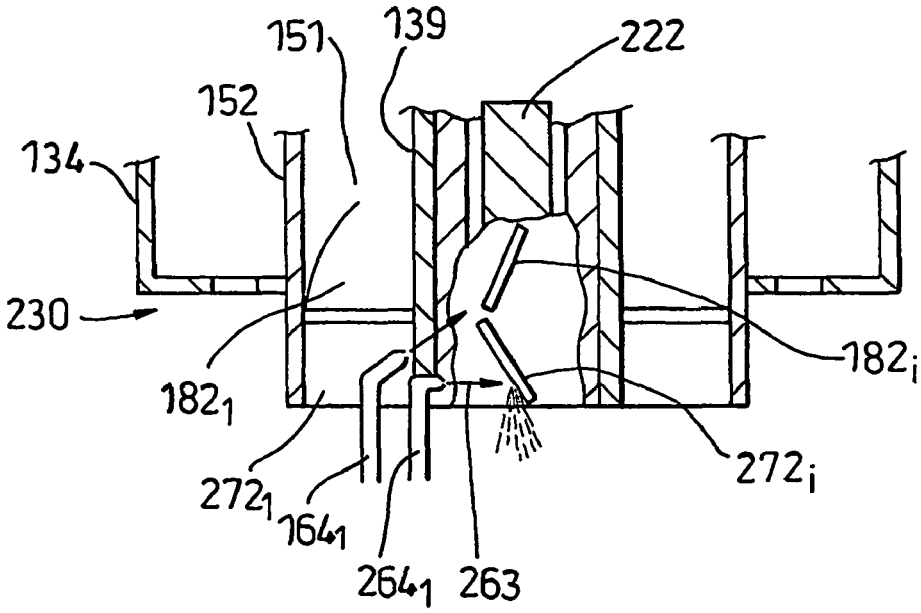
FIG. 6 shows in schematic sectional elevation part of a second embodiment of separation apparatus similar to that of FIG. 1 with only the lower part of the rotor shown and illustrating the provision of separate collection impeller vanes and motor impeller vanes.

Referring to FIG. 6 this shows somewhat schematically a sectional elevation through the base of, and mounted rotor of, a second embodiment of centrifugal separation arrangement 210.

Rotor 230 is substantially as the rotor 110 described above with the exception of the provision of a set of additional motor impeller vanes $\mathbf{272}_1$-$\mathbf{272}_i$, where i=11 or some other integer. The rotor comprises also the above described outer and inner vessel walls 134, 139 and 138, divider wall 152 of inlet region 151 and dual role collection and motor impeller vanes $\mathbf{182}_1 \ldots \mathbf{182}_i$.

The additional motor impeller vanes may differ in number and circumferential position from the dual-role vanes. As shown, they are arranged to receive a free jet of drive fluid 263 (which may be any gas or liquid, including the contaminated liquid) supplied by one or more nozzles $\mathbf{264}_1$ etc in the base and deflect the spent fluid away from the inlet region, such that the fluid is used only to rotate the rotor. A separate nozzle $\mathbf{164}_1$ (or nozzles) directs contaminated liquid for cleaning into the inlet end of the inlet region 151 as a free jet. Such contaminated liquid may interact with the helical collection impeller vanes as described above such that the liquid imparts rotational driving force to the vanes and the vanes constrain the liquid to rotate with the divider wall collection surface and convey it to the transfer passage means.

Such dedicated additional rotor impeller vanes may take any suitable shape and disposition, including the bucket form comprising the known Pelton wheel. Although it is convenient to situate such additional rotor impeller vanes adjacent the inlet end of the inlet means, this is not essential and they may be disposed at any part of the rotor.

As a variant on the second embodiment (not shown), instead of the liquid being injected into the inlet region so as to contribute to the motive power for rotation, whilst being "collected", the direction of the liquid jet from the nozzle $\mathbf{164}_1$ and/or the collection impeller vanes $\mathbf{182}_i$ may be such that the injected liquid contributes nothing to effecting rotor rotation but to a greater or lesser extent extracts energy from the rotating inlet means which serves to pump the liquid towards the transfer passage means with maximum rotational speed, the motive power for rotation being derived only from the separate drive fluid impinging upon the separate motor impeller vanes.

It will be understood that although in the exemplary embodiment of FIG. 6 the discrete additional motor (or sole motor) impeller vanes have been shown with the vanes arranged to direct spent drive fluid away from the inlet region to demonstrate strongly the possible distinction between fluid drive and contaminated liquid collection, such motor impeller vanes may be arranged to direct spent fluid towards the inlet region to be entrained with the primary source of injected contaminated liquid.

Where the collection impeller vanes perform the collection role separately from the motor function the collector impeller means may comprise a single collection impeller vane which serves to guide the liquid with respect to the divider wall surface to prevent uninhibited slippage relative thereto in the circumferential direction; such an arrangement may be considered the equivalent of a pair of such vanes separated by 360 around the rotation axis. However, for the purpose of balanced operation it is preferred to have a plurality of such collection impeller vanes arrayed around the rotation axis.

In yet an alternative embodiment of separation apparatus (not shown), which uses the rotor 130 of FIG. 1, the base may be arranged to direct a free jet of contaminated liquid injected into the inlet means thereof as described but also direct a free jet of gaseous drive fluid along a similar trajectory (preferably displaced circumferentially around the axis) so as to contribute to the motive power and pass through the inlet means and the separation and containment vessel with, but separately from, the contaminated liquid.

In the above described embodiments the rotation axis 124 is defined extending substantially vertically for various reasons, many of which have been established through many years of practice with traditional filled-vessel centrifugal separators, such as ease of access in relation to an engine to which fitted, and insofar as the rotor is alternately rotated and stopped with the engine throughout its operating life it encourages the separated contain ants to stay uniformly distributed about the rotor axis rather than slumping to one side thereof when the rotor is at rest, thereby preserving a better balance when rotation is resumed. However, in principle there is no functional reason for the separation apparatus and its rotor not to have a rotator axis other than vertical.

The above disclosed embodiments not only adopt the traditional vertically extending rotation axis but also a housing 112 whereas the liquid to be cleaned is fed to the rotor from below and drained after discharge by gravity, with the cover 116 being fitted and removed from above. It will be appreciated that the arrangement of FIG. 1 may be substantially inverted with very few modifications to function in a substantially identical manner. Such an arrangement would provide access to the cover and rotor from below the separation apparatus for filling and maintenance with the provision of a drainage duct corresponding to 120, in the cover. It may also be desirable to provide discharge passage means 142 in, or also in, the wall 136 to prevent the vessel from becoming filled with liquid when not rotating at operating speed; insofar as the transfer passage means 156 is adjacent the end wall 136 it is preferred that the outlet passages 143 in end wall 138 function as the normal outlet passage means with such passages in wall 136 dedicated to preventing such unwanted filling of the vessel.

Furthermore, the separation apparatus has been described with an embodiment wherein a fixed axle 122 supports the cover 116 and the rotor 130 mounted for rotation by hub 144. It will be understood that if desired, instead of a fixed axle 122 the hub 144 may be formed with longitudinally projecting stubs which locate in bearing sockets within the housing and cover whereby the rotor carries its own axle.

As described above the rotor separation and containment vessel 132 has its lower end wall 138, through which the outer passage means is formed, extending substantially in a plane that is perpendicular to the rotation axis; it will be appreciated that within the constraints of economical manufacture, that is moulding and/or pressing, the outer peripheral side wall 134 may terminate lower than he outlet passage means, which requires the end wall to be inclined upwardly towards the outlet passage means, or terminate higher than the outlet passage means and require the end wall to be inclined downwardly towards the outlet passage means. There may be perceived some disadvantage in these latter two alternatives, in that the forces exerted on the outer side wall of the vessel by its contents during rotation may be more likely to cause flexing of an end wall that is not perpendicular to the axis, and an end wall which slopes towards the outlet passage means may be considered least desirable in that it not only reduces the amount of containment volume within the rotor but also is more likely to permit separated contaminants to be carried from the zone 140 by exiting liquid and/or dislodged by shock forces. However, insofar as the imperative of this (or indeed any other) high speed centrifugal separation rotor driven at high speed by a free jet fluid motor is to maximise the rotation from the limited motive power available, an important factor is to minimise frictional or other analogous effects that detract from free rotation. It will be appreciated that in a vessel such as that shown in FIG. 1 the liquid discharged from the separation and containment vessel at the outlet passages 143 in end wall 138, and when freed from the rotational constraints of the vessel continues linearly within the housing until it strikes the cover or other housing structure; looked at in relation to the rotating end wall, the discharged liquid tends to move in an outwardly spiraling arc towards and beyond the side wall. Insofar as the liquid spills from the outlet passage means, as a result of overflowing rather than being forcibly ejected at elevated pressure, there exists a possibility of the liquid attaching itself to the end wall and flow thereacross before detachment, and/or splashing from the housing in line with the end wall back onto the vessel, and in either case creates a drag on rotation until finally dislodged so that discharged liquid is potentially a source of rotation impedance.

Referring again to FIG. 3, in accordance with the inventive aim of achieving maximum rotation for the separation zone, there is provided between the outer peripheral wall 134 and the outlet passage means in the end wall 138 a discharged liquid guide 190 extending with respect to the end wall in the direction of the rotation axis. The guide is operable to inhibit contact between liquid discharged from the outlet passage means and the external surface of the vessel 132 radially outwardly of the guide. The guide is conveniently formed integrally with the end wall and in the form of a tubular body coaxial with the rotation axis that extends around the outlet passage means, the slots 143, forming a circumferentially complete skirt. The tubular skirt is conveniently of uniform diameter, extending longitudinally for such a distance that liquid flowing outwardly from the lip or rim 191 thereof does not directly engage with the rotor vessel end wall nor impinge upon the housing at a position where it can splash against, and impedes rotation of, the vessel. The discharged liquid guide need not be of uniform diameter along its length, although this may be influenced by its manufacture. Furthermore, the guide may be disposed anywhere between the outlet passage means and the outer peripheral side wall, although maximum benefit is to be expected by disposing it closer to the outlet passage means, possibly aligned with and comprising an extension of the outlet passage means. The discharged liquid guide may be formed other than integrally with the end wall and may, for example, comprise a discrete tubular guide body (not shown) that is secured to an end wall by adhesives or welding or such a body may be formed with axially extending, upstanding lugs that extend into the outlet passage means and locate it, possibly releasably, with respect to the end wall.

Figure 7:
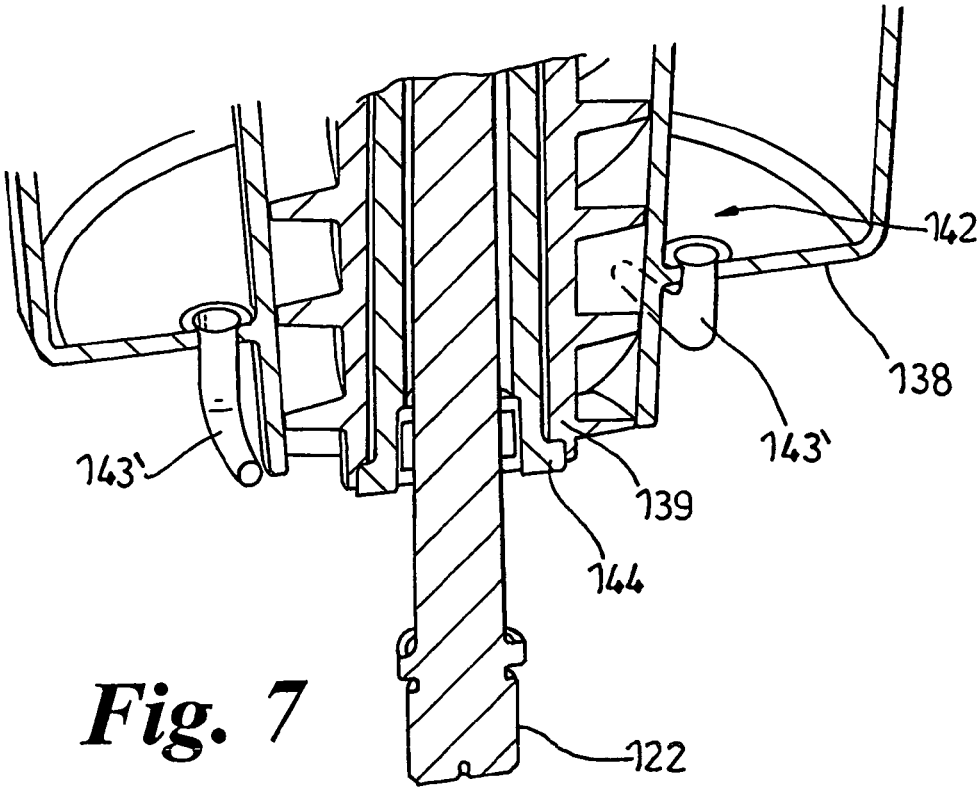
FIG. 7 is a portion of an alternative rotor form, generally similar to that of FIG. 3 but showing different forms of discharged liquid guide.

Referring to FIG. 7 this shows a portion of a separation rotor generally similar to FIG. 3 but wherein the lower end wall 136 includes outlet passage means 142 differing from the simple through apertures 143 that define a weir over which excess liquid can flow to discharge. One or more of apertures 143' arranged about the rotation axis are each defined by a tubular discharge duct extending through and away from the wall whereby the discharged liquid is guided away from unwanted engagement with the rotor or housing wall. Such outlet passage discharge ducts extend with longitudinally respect to the rotation axis 124 and are preferably inclined with respect to the rotation axis in a similar manner to the jet reaction nozzles of a conventional reaction driven centrifuge rotor, although of course the discharged liquid does not here provide a driving force, so that the liquid is discharged in a generally tangential or radially outward direction.

Figure 8:
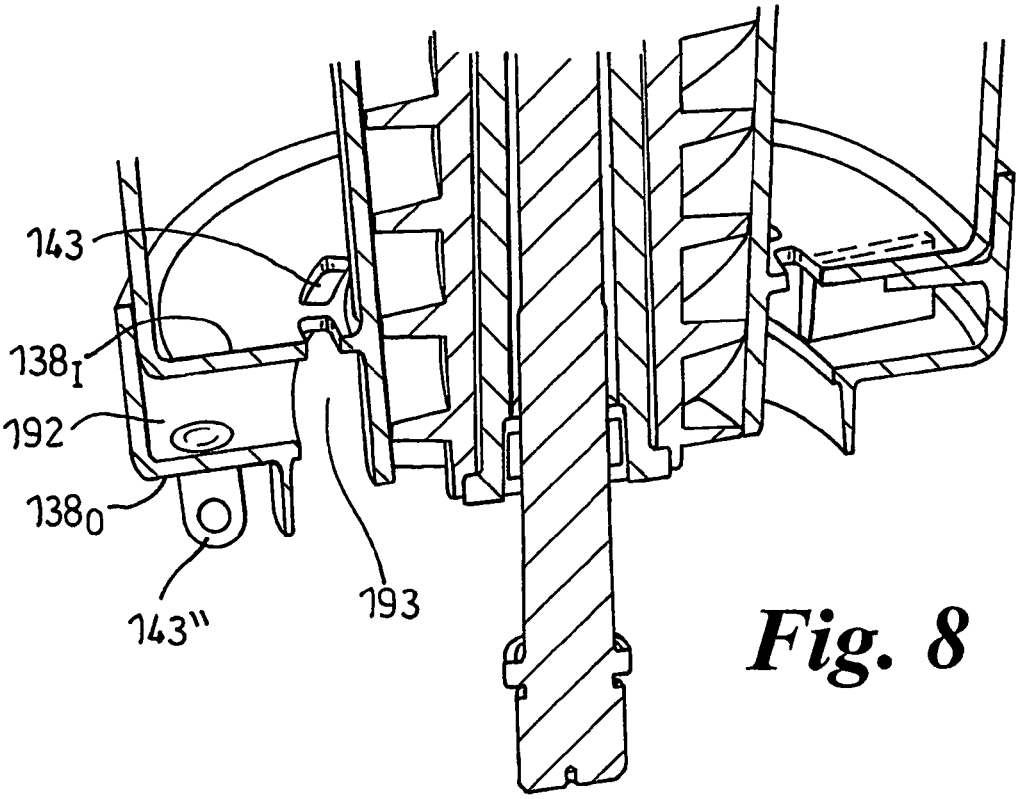
FIG. 8 is a portion of a further rotor form similar to that of FIG. 7 but showing a yet different form of discharged liquid guide.

If desired there may be formed a combination of weir-type outlet passage means as shown in FIGS. 1 to 6 and outlet passage ducts, which inherently form discharged liquid guides, disposed close to the outer peripheral wall 134 whereby some of the liquid held by the centrifugal force of rotation effectively at elevated pressure is forced to leave the vessel by way of such duct forms of outlet passage means. Referring to FIG. 8, the (lower) end wall 138 of this vessel may be provided as a double wall comprising an inner end wall $\mathbf{138}_I$ and an outer end wall $\mathbf{138}_O$ defining therebetween an annular cavity 192.

The outlet passage means 142 is formed by the aforementioned series of slots 143 in the inner end wall $\mathbf{138}_I$ and by an open annulus 193 defined by a radially inner edge $\mathbf{138'}_O$ of the outer end wall $\mathbf{138}_O$. Furthermore, the outer end wall carries at said inner edge an axially extending, tubular skirt forming discharged liquid guide corrsponding to the guide 191 The annular cavity includes a plurality of radially extending divider vanes and one or more outlet passage ducts 143" which extend through the outer end wall and open on a direction opposite to the rotation. In operation, initially at low speed the discharged liquid exits through the annular outlet passages 143 and annulus 193; as speed increases the liquid tends to flow across the inner end wall into the cavity where it accumulates and, in analogous manner to the zone 140 of the vessel, pressure gradually builds, forcing the liquid out by way of the closed ducts 143" and in a direction that discharges it clear of outer end wall of the vessel. If the flow of liquid through the vessel (zone 140) increases and the cavity 192 fills, the anular passage 193 with surrounding skirt provides also outlet passage and discharged liquid guide. The outer end wall and outlet passage ducts therein may be a separate structure mounted with respect to an erstwhile single end wall 136 of the vessel (as shown in FIG. 1).

Although the embodiments shown and described have the outlet passage means in the lower end of the vessel, this is not essential and such passage means may be formed alternatively and/or additionally at the upper end of wall 136. In such event, such discharged liquid guide means is of even greater value to counter the effects of gravity driving the discharged liquid towards the rotor to impede its rotation.

It will be appreciated that the discharged liquid guide functions independently of the structure of the inlet means, that is, irrespective of the presence or absence of helical collection impeller vanes and accordingly may be employed with open vessel centrifugal rotors such as those described in the aforementioned WO 02/055207.

The invention claimed is:

1. A centrifugal separation rotor for centrifugal separation apparatus for separating solid contaminants from liquid, the rotor comprising:

a walled contaminant separation and containment vessel having a longitudinally extending rotation axis, an impervious outer side wall extending about and along the rotation axis spaced radially therefrom and at least one end wall extending from the side wall towards the rotation axis, an outlet passage, leading externally of the vessel, disposed radially inwardly with respect to the outer side wall, said walls defining radially inwardly from the outer side wall an annular contaminant separation and containment zone and the outlet passage defining the radial boundary of the zone, an inlet, arranged to receive liquid to be cleaned and convey it to the contaminant separation and containment zone at a rate less than liquid can be passed by the outlet passage, a mounting arrangement for mounting the rotor for rotation of the vessel about the longitudinal rotation axis, and a fluid motor impeller disposed to receive a jet of drive fluid thereagainst and responsive to drive fluid impingement to rotate the rotor about said longitudinal rotation axis, said inlet further comprising a liquid inlet region, defined about and along the rotation axis by a divider wall disposed radially between the outlet passage and the rotation axis, having a liquid inlet end, a transfer passage, spaced from the inlet end, permitting liquid flow between the inlet region and contaminant separation and containment zone, and a collection face of said divider wall facing inwardly towards the rotation axis, wherein the inlet includes a collection impeller comprising at least one collection impeller vane, each vane upstanding with respect to the divider wall collection face into the inlet region and extending about the rotation axis and along the divider wall from said inlet end towards said transfer passage along a helical path, to constrain the liquid to be cleaned injected into the inlet region to follow a helical path in the direction of rotation of the rotor inlet towards the transfer passage, wherein the fluid motor impeller comprises a plurality of motor impeller vanes disposed at or adjacent the inlet end of the inlet, each upstanding with respect to said dividing wall collection face, wherein the motor impeller vanes extend about the rotation axis and along the divider wall from said inlet end towards said transfer passage in the same directional sense as the collection impeller vanes, wherein the motor impeller vanes each have a primary face facing in a direction towards the transfer passage and are arranged to receive drive fluid injected into the inlet region on said primary face and deflect spent fluid in a direction between said collection impeller vanes towards the transfer passage, wherein the helix pitch angle of each collection impeller vane is substantially equal to 45 degrees, and wherein the impeller comprises an assembly of three integral moldings of plastics material, a first moldings comprising one end wall, the inner side wall and at least one collection impeller vane, a second moldings comprising an end wall and divider wall dimensioned to receive at least some of the impeller vanes in contact with the collection face thereof, at least one of said first and second moldings including at least part of the outer side wall, and a third moldings comprising a mounting hub dimensioned to receive the inner side wall therearound, the centrifugal separation rotor further comprising at least one end wall thereof, extending from the outer peripheral wall towards the rotation axis, including an outlet passage and, between the outer peripheral wall and the outlet passage of at least one end wall, and a discharged liquid guide extending longitudinally with respect to a said end wall operable to inhibit contact between liquid discharged from the rotor vessel by way of the outlet passage and the external surface of the rotor vessel radially outwardly of the discharged liquid guide.

2. A centrifugal separation rotor as claimed in claim 1 in which the discharged liquid guide extends around the outlet passage as a circumferentially complete skirt.

3. A centrifugal separation rotor for centrifugal separation apparatus for separating solid contaminants from liquid, the rotor comprising:

a walled contaminant separation and containment vessel having a longitudinally extending rotation axis, an impervious outer side wall extending about and along the rotation axis spaced radially therefrom and at least one end wall extending from the side wall towards the rotation axis, an outlet passage, leading externally of the vessel, disposed radially inwardly with respect to the outer side wall, said walls defining radially inwardly from the outer side wall an annular contaminant separation and containment zone and the outlet passage defining the radial boundary of the zone, an inlet, arranged to receive liquid to be cleaned and convey it to the contaminant separation and containment zone at a rate less than liquid can be passed by the outlet passage, a mounting arrangement for mounting the rotor for rotation of the vessel about the longitudinal rotation axis, and a fluid motor impeller disposed to receive a jet of drive fluid there against and responsive to drive fluid impingement to rotate the rotor about said longitudinal rotation axis, said inlet further comprising a liquid inlet region, defined about and along the rotation axis by a divider wall disposed radially between the outlet passage and the rotation axis, having a liquid inlet end, a transfer passage, spaced from the inlet end, permitting liquid flow between the inlet region and contaminant separation and containment zone, and a collection face of said divider wall facing inwardly towards the rotation axis, wherein the inlet includes a collection impeller comprising at least one collection impeller vane, each vane upstanding with respect to the divider wall collection face into the inlet region and extending about the rotation axis and along the divider wall from said inlet end towards said transfer passage along a helical path, to constrain the liquid to be cleaned injected into the inlet region to follow a helical path in the direction of rotation of the rotor inlet towards the transfer passage, the centrifugal separation rotor further comprising at least one end wall thereof, extending from the outer peripheral wall towards the rotation axis, including an outlet passage and, between the outer peripheral wall and the outlet passage of at least one end wall, a discharged liquid guide extending longitudinally with respect to a said end wall operable to inhibit contact between liquid discharged from the rotor vessel by way of the outlet passage and the external surface of the rotor vessel radially outwardly of the discharged liquid guide.

4. A centrifugal separation rotor as claimed in claim 3 in which the fluid motor impeller includes a plurality of motor impeller vanes disposed at or adjacent the inlet end of the inlet, each motor impeller vane upstanding with respect to said dividing wall collection face, the motor impeller vanes extending about the rotation axis and along the divider wall from said inlet end towards said transfer passage in the same directional sense as the collection impeller vanes.

5. A centrifugal separation rotor as claimed in claim 4 in which the motor impeller vanes each have a primary face facing in a direction towards the transfer passage and are arranged to receive drive fluid injected into the inlet region on said primary face and deflect spent fluid in a direction between said collection impeller vanes towards the transfer passage.

6. A centrifugal separation rotor as claimed in claim 5 in which the helix pitch angle of each collection impeller vane is in the range 35 to 55 degrees.

7. A centrifugal separation rotor as claimed in claim 6 in which the helix pitch angle of each collection impeller vane is substantially equal to 45 degrees.

8. A centrifugal separation rotor as claimed in claim 7 in which the rotor comprises an assembly of three integral moldings of plastics material, a first moldings comprising one end wall, the inner side wall and at least one collection impeller vane, a second moldings comprising an end wall and divider wall dimensioned to receive at least some of the impeller vanes in contact with the collection face thereof, at least one of said first and second moldings including at least part of the outer side wall, and a third moldings comprising a mounting hub dimensioned to receive the inner side wall therearound.

9. A centrifugal separation rotor as claimed in claim 3 in which the helix pitch angle of each collection impeller vane is in the range 35 to 55 degrees.

10. A centrifugal separation rotor as claimed in claim 3 in which the helix pitch angle of each collection impeller vane is substantially equal to 45 degrees.

11. A centrifugal separation rotor as claimed in claim 3 in which the rotor comprises an assembly of three integral moldings of plastics material, a first moldings comprising one end wall, the inner side wall and at least one collection impeller vane, a second moldings comprising an end wall and divider wall dimensioned to receive at least some of the impeller vanes in contact with the collection face thereof, at least one of said first and second moldings including at least part of the outer side wall, and a third moldings comprising a mounting hub dimensioned to receive the inner side wall therearound.

* * * * *